US009277849B2

(12) United States Patent
Monsrud et al.

(10) Patent No.: US 9,277,849 B2
(45) Date of Patent: Mar. 8, 2016

(54) COMBINATION DISHWASHING MACHINE AND SINK

(75) Inventors: Lee J. Monsrud, Inver Grove Heights, MN (US); Daniel F. Brady, High Point, NC (US); Darryl C. Bowling, Madison, NC (US); Eddie D. Sowle, Woodbury, MN (US); Matthew C. Porter, West St. Paul, MN (US)

(73) Assignee: Ecolab USA Inc., St. Paul, MN (US)

( * ) Notice: Subject to any disclaimer, the term of this patent is extended or adjusted under 35 U.S.C. 154(b) by 1446 days.

(21) Appl. No.: 12/917,839

(22) Filed: Nov. 2, 2010

(65) Prior Publication Data

US 2012/0103364 A1 May 3, 2012

(51) Int. Cl.
*A47L 15/42* (2006.01)
*A47L 15/00* (2006.01)

(52) U.S. Cl.
CPC ..... *A47L 15/4291* (2013.01); *A47L 15/0055* (2013.01); *A47L 15/0086* (2013.01)

(58) Field of Classification Search
CPC combination set(s) only.
See application file for complete search history.

(56) References Cited

U.S. PATENT DOCUMENTS 1,572,686 A 2/1926 Schertz
1,645,815 A * 10/1927 Murdoch ..... 134/186
2,709,444 A 5/1955 Ortega
2,722,941 A 11/1955 Bartlett
2,750,950 A 6/1956 Inman et al.
3,108,754 A * 10/1963 Low ..... A47L 15/0031 134/115 G
3,230,961 A * 1/1966 Detterbeck et al. ..... 134/60
3,384,099 A 5/1968 Baumann
3,698,406 A 10/1972 Sato et al.
3,709,236 A 1/1973 Field et al.
3,807,636 A 4/1974 Fackler
3,949,772 A 4/1976 Hartmann
4,146,405 A * 3/1979 Timmer ..... A47L 15/23 134/115 R
4,776,359 A * 10/1988 Federighi, Jr. ..... A47L 15/4291 134/111
5,031,650 A 7/1991 Nagata et al.
5,165,431 A * 11/1992 Tromblee ..... A47L 15/486 134/102.1
5,193,562 A 3/1993 Rigby et al.
5,357,992 A 10/1994 Yang
5,732,724 A 3/1998 Becknell
5,934,298 A * 8/1999 Singh ..... 134/85

(Continued)

FOREIGN PATENT DOCUMENTS

KR 100867531 B1 * 10/2008

OTHER PUBLICATIONS

Machine Translation of KR 100867531 to Kim, Oct. 2008.*

(Continued)

*Primary Examiner* — Michael Barr
*Assistant Examiner* — Benjamin L Osterhout
(74) *Attorney, Agent, or Firm* — IPLM Group, P.A.

(57) ABSTRACT

In one aspect of the present invention, a combination dishwashing machine and sink that utilizes a first use solution includes a dishwashing machine, a sump, a pump, a sink, a first fluid passageway, and a controller. The sump is in fluid communication with the dishwashing machine and is configured and arranged to contain the first use solution utilized in the dishwashing machine. The pump is in fluid communication with the sump, and the first fluid passageway interconnects the pump and the sink. The controller is operatively connected to the pump and is programmed to signal the pump to direct the first use solution from the sump, through the first fluid passageway, and into the sink. The controller automates the filling of the sink with the first use solution from the sump.

31 Claims, 12 Drawing Sheets

(56) References Cited

U.S. PATENT DOCUMENTS

| | | | | |
|---|---|---|---|---|
| 6,092,114 | A | 7/2000 | Shaffer et al. | |
| 6,092,540 | A | 7/2000 | Chiao | |
| 6,092,541 | A | 7/2000 | Crane et al. | |
| 6,101,643 | A * | 8/2000 | Moore | 4/631 |
| 6,289,908 | B1 * | 9/2001 | Kelsey | 134/200 |
| 6,659,114 | B2 | 12/2003 | Bigott | |
| 2003/0205246 | A1 * | 11/2003 | Christman | A47L 15/0086 134/18 |
| 2003/0205256 | A1 * | 11/2003 | DeBoer et al. | 134/115 R |
| 2004/0194810 | A1 | 10/2004 | Strothoff et al. | |

OTHER PUBLICATIONS

"Salvajor Scrap Collector—How It Works", The Salvajor Company, Kansas City, Missouri, USA, 1 page, date of printing unknown (art known of prior to filing of present application).

* cited by examiner

COMBINATION DISHWASHING MACHINE AND SINK

FIELD OF THE INVENTION

The present invention relates to a combination dishwashing machine and sink.

BACKGROUND OF THE INVENTION

Restaurants such as quick serve restaurants typically value the soaking action of a power soak sink and also value the convenience of a dishwashing machine for items that do not require soaking. Two separate systems are used to perform each function.

Restaurants typically utilize a three sink system to clean and sanitize dishes that may be too large to fit inside a dishwashing machine or that may require pre-soaking because they are too soiled. A typical three sink system includes a wash sink, a rinse sink, and a sanitize sink. Alternatively, a single sink may be used as a soak sink to pre-soak dishes, and the soak sink is similar to the wash sink in the three sink system.

The operation of the three sink system and the soak sink is typically very manually intensive, which increases the opportunities for operator error or possibly even neglect. For example, the wash sink or the soak sink is typically manually filled with water, the desired amount of chemical is added, the dishes are allowed to soak, the sink agitator is activated (if available), and the water and the chemical in the sink are manually refilled and/or refreshed when it becomes too soiled.

It is desired to automate some of the steps in operation of the three sink system or the soak sink to help reduce the likelihood of operator error and neglect and to ensure proper cleaning and sanitization of dishes.

SUMMARY OF THE INVENTION

In one aspect of the present invention, a combination dishwashing machine and sink that utilizes a first use solution includes a dishwashing machine, a sump, a pump, a sink, a first fluid passageway, and a controller. The sump is in fluid communication with the dishwashing machine and is configured and arranged to contain the first use solution utilized in the dishwashing machine. The pump is in fluid communication with the sump, and the first fluid passageway interconnects the pump and the sink. The controller is operatively connected to the pump and is programmed to signal the pump to direct the first use solution from the sump, through the first fluid passageway, and into the sink. The controller automates the filling of the sink with the first use solution from the sump.

In another aspect of the present invention, a combination dishwashing machine and sink for use with a dispenser for dispensing a use solution includes a dishwashing machine, a sink, a sump, a first fluid passageway, a first pump, a second fluid passageway, a second pump, and a controller. The dishwashing machine has a nozzle within a cavity, and the sump is in fluid communication with the cavity of the dishwashing machine. The use solution drains from the cavity into the sump, and the sump is configured and arranged to contain the use solution utilized in the dishwashing machine. The first fluid passageway interconnects the nozzle of the dishwashing machine and the sump, and the first pump is in fluid communication with the sump and the nozzle. The second fluid passageway interconnects the sink and the sump, and the second pump is in fluid communication with the sump and the sink. The controller is operatively connected to the first pump and to the second pump. The controller is programmed to signal the first pump to direct the use solution from the sump into the nozzle via the first fluid passageway, and the controller is programmed to signal the second pump to direct the use solution from the sump into the sink via the second fluid passageway.

In another aspect of the present invention, a combination dishwashing machine and sink for use with a dispenser for dispensing a use solution includes a dishwashing machine, a sink, a fluid passageway, and a pump. The dishwashing machine has a cavity and a nozzle contained within the cavity. The cavity is configured and arranged to contain first dishes. The sink is in fluid communication with the cavity and is configured and arranged to contain second dishes. The sink stores the use solution and soaks the second dishes with the use solution. The fluid passageway interconnects the nozzle and the sink, and the pump directs the use solution from the sink into the nozzle via the fluid passageway. The nozzle applies the use solution onto the first dishes in the cavity, the use solution drains into the sink after use in the cavity, and the pump re-circulates the use solution from the sink into the cavity. The use solution concurrently cleans the first dishes and soaks the second dishes.

In another aspect of the present invention, a retrofit kit for converting a sink into a combination dishwashing machine and sink includes a dishwashing machine having a nozzle, a controller, and a pump. The pump has an inlet valve and an outlet valve, and the pump is in fluid communication with the dishwashing machine and the sink. The controller is operatively connected to the inlet valve and the outlet valve. The controller is programmed to open the inlet valve and the outlet valve toward the dishwashing machine when directing a use solution to the nozzle of the dishwashing machine, and the controller is programmed to open the inlet valve and the outlet valve toward the sink when directing the use solution to the sink.

In another aspect of the present invention, a method of automatically filling a sink with a use solution including a detergent utilized in a dishwashing machine includes collecting the use solution utilized in the dishwashing machine, directing the use solution collected from the dishwashing machine into the sink, and filling the sink with the use solution collected from the dishwashing machine.

DETAILED DESCRIPTION OF A PREFERRED EMBODIMENT

Figure 1:
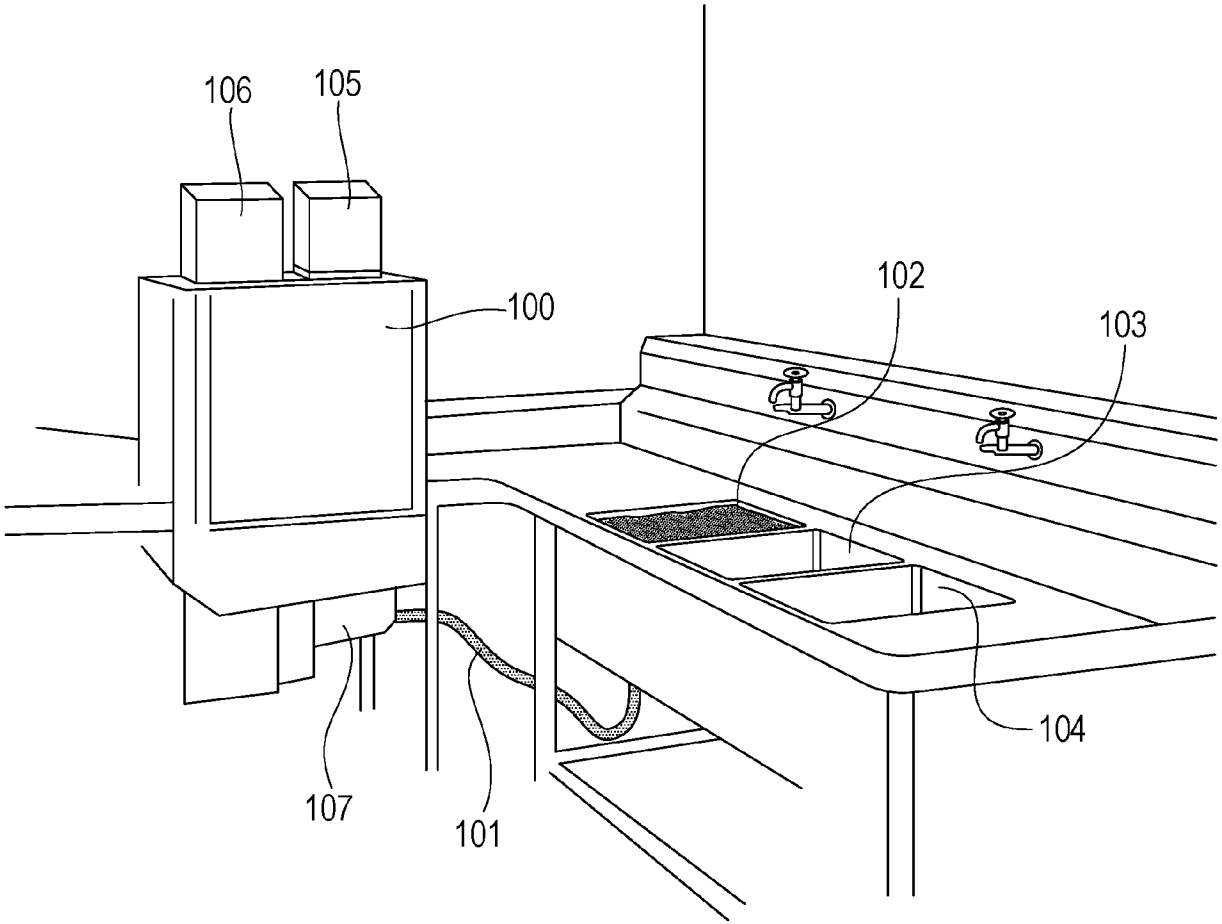
FIG. 1 is a perspective view of a combination dishwashing machine and sink constructed according to the principles of the present invention.

The present invention relates to a combination dishwashing machine and sink. A general concept of the present invention is shown in FIG. 1. A pump 107 directs wash water from a dishwashing machine 100 to a drain (not shown) of a wash sink 102 via a fluid passageway 101. It is recognized that one or more sinks could be used. If a three sink system is desired, a rinse sink 103 and a sanitize sink 104 may also be included as shown. A detergent dispenser 105 and a sanitizer dispenser 106 may be mounted to the top of the dishwashing machine 100 for dispensing detergent and sanitizer into the dishwashing machine 100.

Many different types of dishwashing machines may be used with the present invention. Examples of types of dishwashing machines that could be used with the present invention include door-type dishwashing machines (Model ES-2000 by Ecolab Inc. of St. Paul, Minn., Model AM-14 by Hobart Manufacturing Company of Troy, Ohio), single tank conveyor dishwashing machines (Model ES4400 by Ecolab Inc.), multiple tank conveyor dishwashing machines (Model C-64 by Hobart Manufacturing Company), and flight-type dishwashing machines (Model FT900 by Hobart Manufacturing Company). The dishwashing machine could be hot water sanitizing or chemical sanitizing. Furthermore, the dishwashing machine could be a "dump and fill" type or a "re-circulating" type. It is recognized that any suitable dishwashing machine known in the art could be used with the present invention.

A variety of different types of sinks may be retrofitted for connection to a dishwashing machine according to the principles of the present invention. Once the dishwashing machine is connected to the sink, the sink is converted from a normal sink into a power soak sink. A retrofit kit, which may be included with the dishwashing machine or which may be used to interconnect the dishwashing machine and the sink, includes plumbing connections, tubing, valves, and in-sink wash jets to direct the circulation of the wash water from the dishwashing machine to the sink.

In one aspect of the present invention, a "dump and fill" type dishwashing machine, which is well known in the art, may be used with a sink system such as a three sink system. FIGS. 2-6 show a typical "dump and fill" type dishwashing machine 200 in which the rinse water becomes the wash water in the next cycle of the dishwashing machine 200. Generally, the rinse water is held in a sump 206 of the dishwashing machine 200 in which detergent is added to create the wash water for the next cycle. The wash water from the dishwashing machine 200 is then directed to the sink 210 thereby filling the sink 210 via the dishwashing machine 200.

More particularly, the dishwashing machine 200 includes a cavity 201 of a housing 217 in which a rack 202 is positioned for holding dishes 203 within the cavity 201. Upper rinse arms 222 supply rinse water within the cavity 201 proximate the top of the housing 217 and lower rinse arms 223 supply rinse water within the cavity 201 proximate the bottom 226 of the housing 217 as is well known in the art. Similarly, upper wash arms 204 supply wash water within the cavity 201 proximate the top of the housing 217 and lower wash arms 205 supply wash water within the cavity 201 proximate the bottom 226 of the housing 217 as is also well known in the art. It is recognized that many suitable types of nozzles, including spray arms, could be used. The bottom 226 of the housing 217 slants downward into a sump 206 so that the rinse water and the wash water used during operation of the dishwashing machine 200 drain by gravity from the bottom 226 of the housing 217 into the sump 206. A fluid passageway 218 interconnects the sump 206 and a pump 207, and a fluid passageway 219 interconnects the pump 207 and the wash arms 204 and 205.

Although three sinks are shown, it is recognized that one or more sinks may be used. Sink 210 is preferably the wash sink having an agitator 214 and a drain 215, sink 220 is preferably the rinse sink having a drain 221, and sink 224 is preferably the sanitize sink having a drain 225. The drains 215, 221, and 225 are in fluid communication with a drain fluid passageway 212 which is in fluid communication with a common drain 228 for disposing of the waste water from each of the sinks.

The dishwashing machine also preferably includes two valves proximate the pump 207. A pump inlet valve 208 interconnects the fluid passageway 218 and the pump 207, and a pump outlet valve 209 interconnects the pump 207 and the fluid passageway 219. The valves 208 and 209 are preferably two-way valves. The sink 210 is connected to the dishwashing machine 200 via the pump inlet valve 208 and the pump outlet valve 209. An inlet fluid passageway 211 interconnects the pump outlet valve 209 of the pump 207 and the drain 215 of the sink 210. A drain fluid passageway 212 interconnects the pump inlet valve 208 of the pump 207, the drain 215 of the sink 210, the drain 221 of the sink 220, the drain 225 of the sink 224, and the common drain 228.

Figure 2:
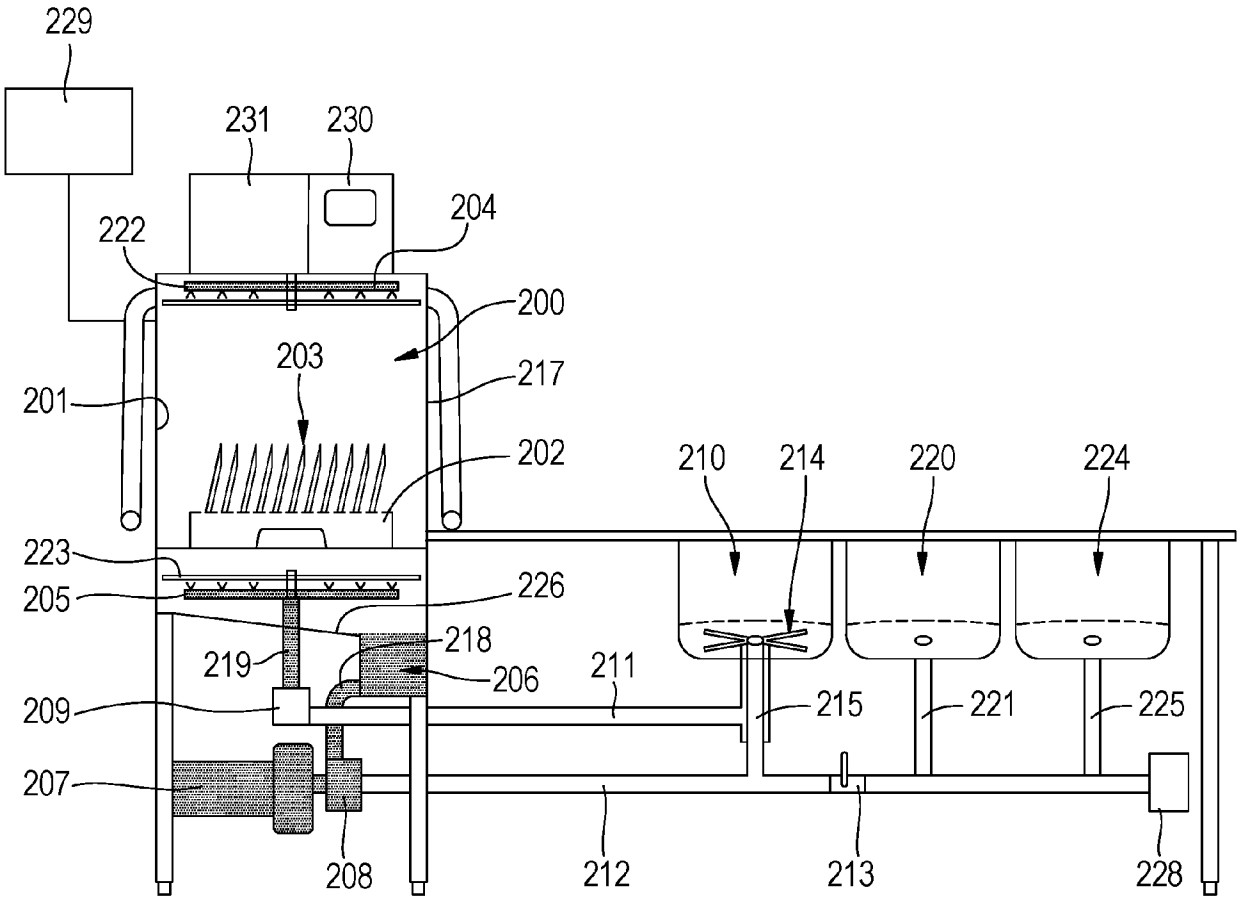
FIG. 2 is a side view of another embodiment combination dishwashing machine and sink constructed according to the principles of the present invention during operation of the dishwashing machine.

During the cycle of the dishwashing machine 200, a fresh water supply (not shown) supplies fresh water to the rinse arms 222 and 223. The rinse water used during the rinse cycle of the dishwashing machine 200 drains into the sump 206, and detergent from a detergent dispenser 230 is added to the rinse water to create the wash water in the sump 206 for use in the next wash cycle of the dishwashing machine 200. As shown in FIG. 2, the wash water is pumped via pump 207 from the sump 206 into the wash arms 204 and 205 for distribution into the cavity 201. The valves 208 and 209 are opened toward the dishwashing machine 200. The wash water enters the pump 207 through the pump inlet valve 208 and exits the pump 207 through the pump outlet valve 209. More specifically, the wash water flows from the sump 206, through the fluid passageway 218, through the pump inlet valve 208, through the pump 207, through the pump outlet valve 209, through the fluid passageway 219, and through the wash arms 204 and 205. The wash water used during the wash cycle of the dishwashing machine 200 drains into the sump 206.

Figure 5:
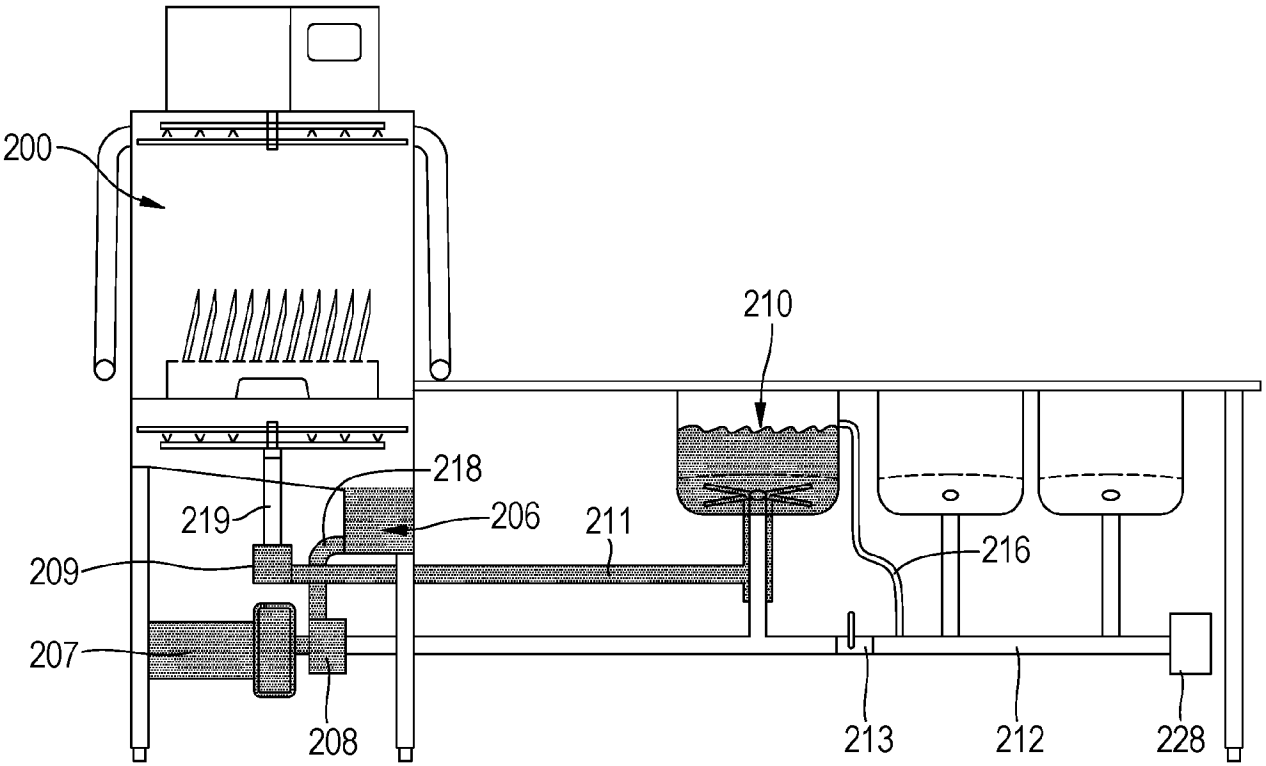
FIG. 5 is a side view of the combination dishwashing machine and sink shown in FIG. 2 during operation of filling the sink with wash water used during the wash cycle of the dishwashing machine.

After the wash cycle, the wash water in the sump 206 is pumped into the sink 210 by the pump 207, as shown in FIG. 5. The valves 208 and 209 are opened toward the sink 210. The pump 207 pumps the wash water from the sump 206 through the inlet fluid passageway 211 and the drain fluid passageway 212 into the drain 215 and the sink 210 to circulate the wash water in the sink 210. The valve 213 is in a closed position to prevent the wash water from going down the drain 228. When it is desired to drain the sink 210, the valve 213 is placed in an open position.

Figure 3:
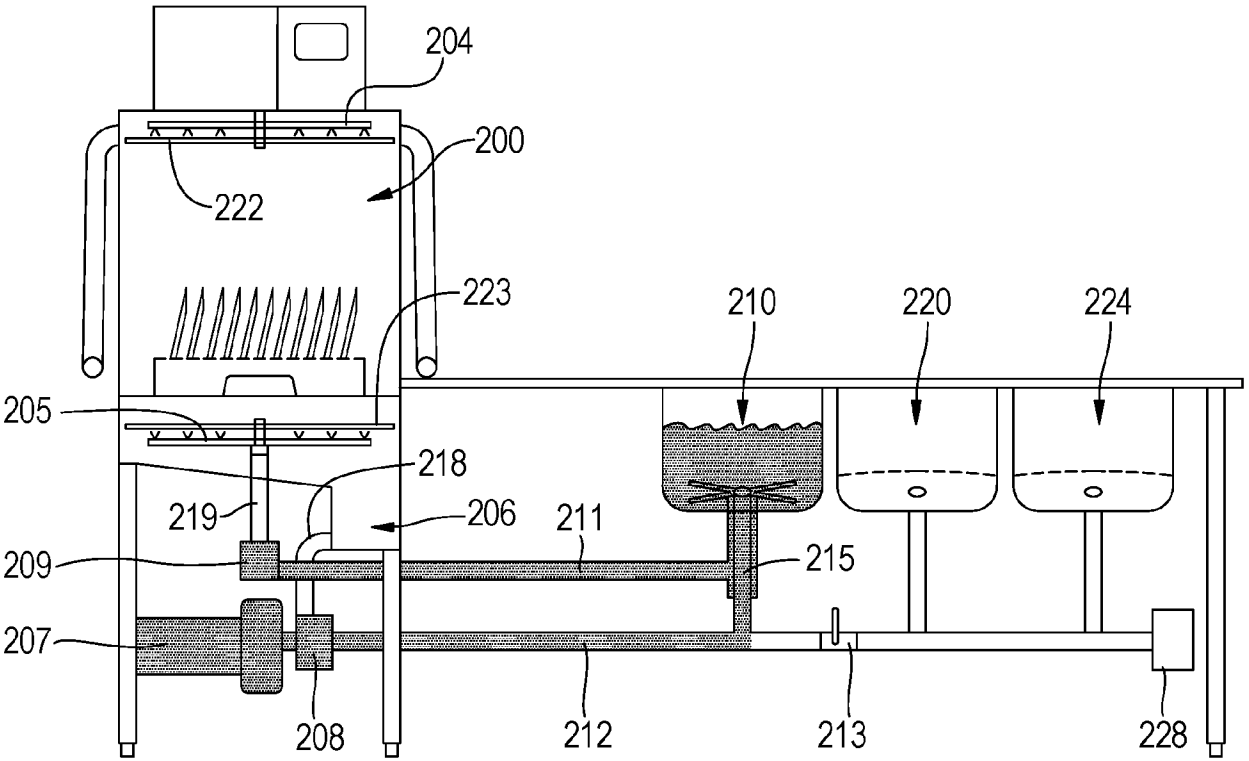
FIG. 3 is a side view of the combination dishwashing machine and sink shown in FIG. 2 during operation of the sink with wash water from the dishwashing machine.

Because the pump 207 is used to circulate the wash water from the dishwashing machine 200 to the sink 210 and to refresh the wash water in the sink 210 with the wash water from the dishwashing machine 200, water and energy in heating the wash water in the sink 210 are saved. The wash water from the dishwashing machine 200 is relatively clean compared to that of the sink 210, and the wash water from the dishwashing machine 200 is approximately 180° F. Although the dishwashing machine 200 and the sink 210 utilize the same pump 207, the pump 207 is not used simultaneously in the dishwashing machine 200 and in the sink 210. The dishwashing machine 200 takes precedence over the sink 210 because the pump 207 does not have enough flow to circulate both devices at the same time. Whenever a cycle of the dishwashing machine 200 is started, the circulation in the sink 210 is temporarily halted. Since the cycles of the dishwashing machine 200 are relatively short in duration, approximately 60 to 90 seconds, the short pause does not adversely affect the operation of the sink 210. The sequencing is preferably done by controlling the valves 208 and 209, which are preferably two-way valves. During operation of the dishwashing machine 200, the valves 208 and 209 are open toward the dishwashing machine 200, as shown in FIG. 2. During operation of the sink 210, the valves 208 and 209 are open toward the sink 210, as shown in FIG. 3, to circulate the wash water in the sink 210.

Figure 4:
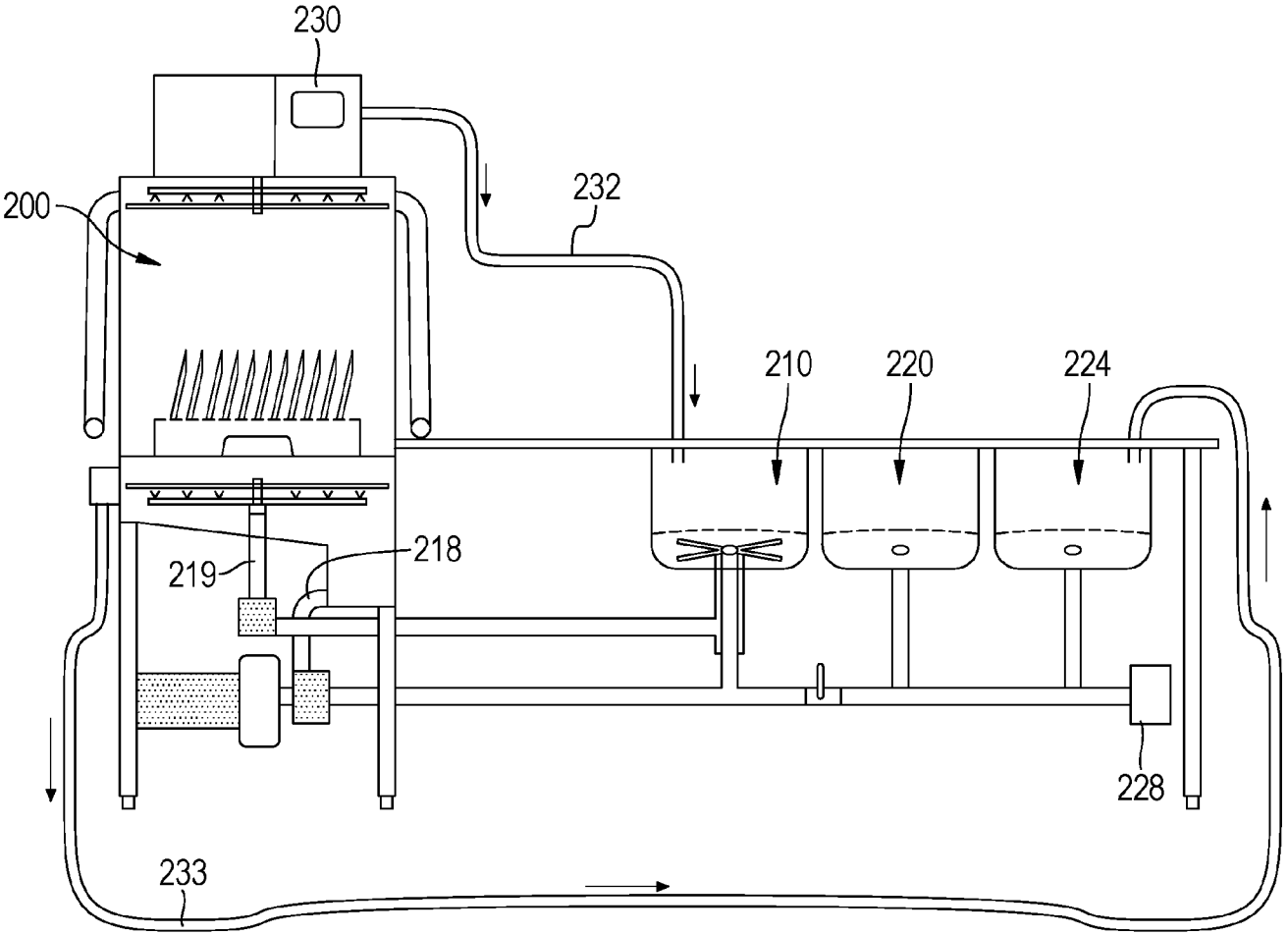
FIG. 4 is a side view of the combination dishwashing machine and sink shown in FIG. 2 showing schematically product passageways directing product to the respective sink.

A detergent dispenser 230 and a sanitizer dispenser 231 may be mounted to the top of the housing 217 for dispensing detergent and sanitizer into the dishwashing machine 200 and into the respective sinks 210 and 224. As shown in FIG. 4, a detergent passageway 232 directs detergent from the detergent dispenser 230 to sink 210, and a sanitizer passageway 233 directs sanitizer from the sanitizer dispenser 231 to sink 224.

As shown in FIG. 5, an optional overflow 216 may interconnect and be in fluid communication with the sink 210 and the drain fluid passageway 212 between the valve 213 and the drain 228. The overflow 216 is positioned at a desired height for the wash water level within the sink 210. As the sink 210 is filled with wash water, any wash water above the bottom of the opening of the overflow 216 flows through the overflow 216, into the drain fluid passageway 212, and then into the drain 228 thereby keeping the wash water at the desired height within the sink 210.

Figure 6:
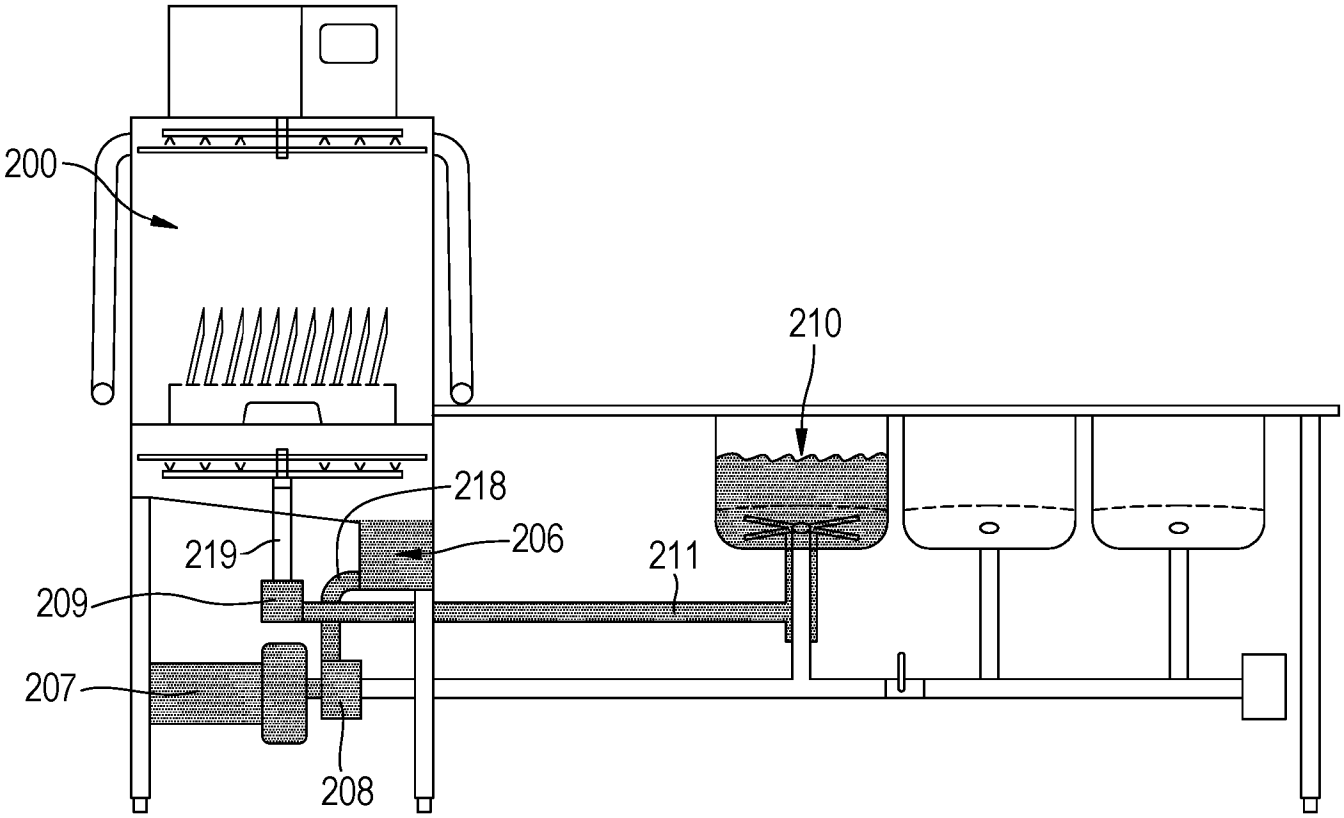
FIG. 6 is a side view of the combination dishwashing machine and sink shown in FIG. 2 during operation of filling the sink with wash water from the dishwashing machine.

Further, the sink 210 may be filled automatically through the dishwashing machine 200. Filling the sink 210 via the dishwashing machine 200 may be accomplished by putting the dishwashing machine 200 in a "fill" mode while concurrently pumping the fill water to the sink 210. Detergent is dispensed along with the fill water of the dishwashing machine 200 into the sink 210. The pump inlet valve 208 is opened toward the dishwashing machine 200 and the pump outlet valve 209 is opened toward the sink 210. This allows for wash water to fill both the sump 206 and the sink 210, which is shown in FIG. 6. A sensor in communication with the sink 210 could be employed to sense the wash water level within the sink 210 and signal the electronic controller to shut off the water fill. Alternatively, a separate fill valve (not shown) from the hot water pipe could be used to fill the sink 210 via the dishwashing machine 200 controls.

An electronic controller 229 is preferably used to sequence the operations of the dishwashing machine 200 and the sink 210, as shown schematically in FIG. 2. Electronic controllers are well known in the art. The electronic controller is also used to regulate the amount of chemical dispensed to both the dishwashing machine 200 and the sink 210. As shown in FIG. 4, a solid product detergent dispenser is preferably located on top of the dishwashing machine 200. By utilizing a detergent that is non-caustic and non-corrosive, the detergent can be used in the sink 210 as well as in the dishwashing machine 200. The detergent is preferably mild so that it does not irritate users' skin as the users are adding dishes to and retrieving dishes from the wash water in the sink 210. The detergent is also preferably non-foaming so that it does not affect the pressure of the pump 207.

A liquid sanitizer dispenser is also preferably located on top of the dishwashing machine 200. Output from the dispenser pump, such as a peristaltic pump or any other suitable pump, is directed to either the dishwashing machine 200 or to the sanitize sink 224. The electronic controller meters the appropriate amount of liquid sanitizer for either application. The sanitize sink 224 is preferably the third sink in the three sink system that includes the wash sink 210, the rinse sink 220, and the sanitize sink 224, preferably in that sequence.

Figure 12:
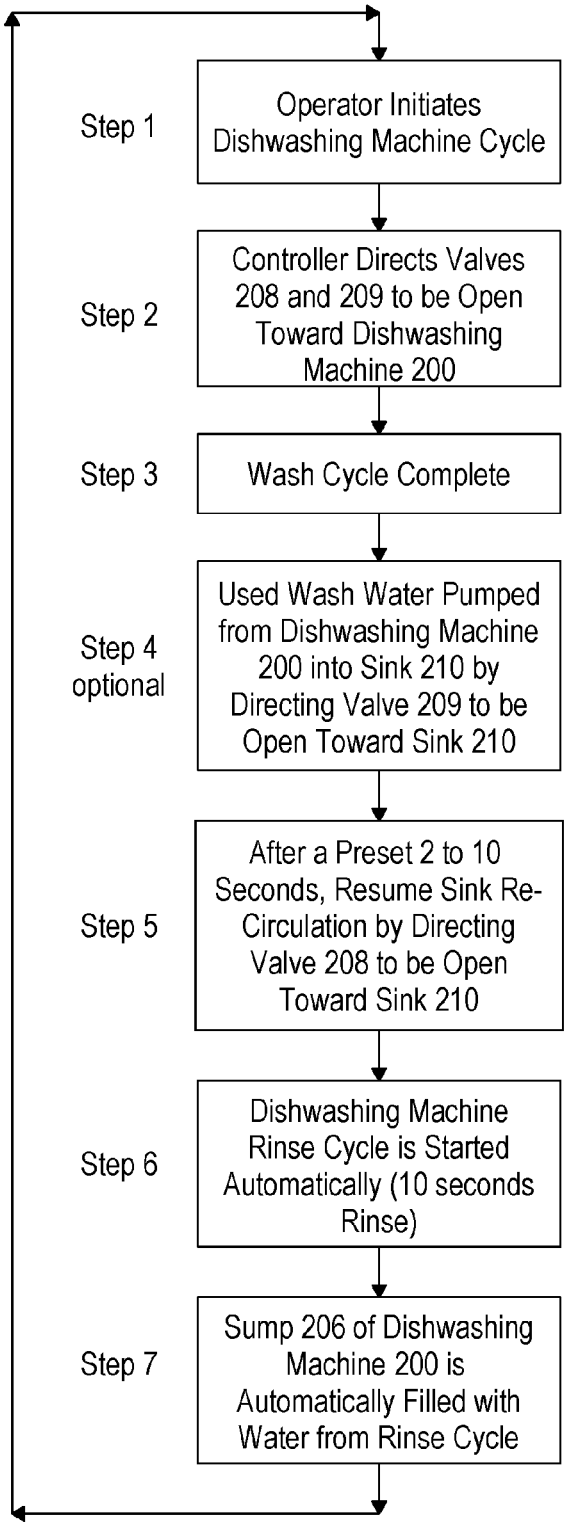
FIG. 12 illustrates a possible sequence of operations of the dishwashing machine and sink of FIGS. 2-6.

In operation, preferably, the operator initiates a dishwashing machine cycle, and the electronic controller 229 directs the valves 208 and 209 to be open toward the dishwashing machine 200, as shown in FIG. 2. After the wash cycle is completed, the used wash water is optionally pumped from the dishwashing machine into the sink by directing the valve 209 to be open toward the sink, as shown in FIG. 5. After a preset time, preferably 2 to 10 seconds, re-circulation of the water in the sink resumes by directing the valve 208 to be open toward the sink, as shown in FIG. 3. This re-circulation state continues until the operator initiates another cycle. The rinse cycle is started automatically and is preferably 10 seconds, and the dishwashing machine wash tank (sump 206) is automatically filled with water from the rinse cycle. This sequence of operations is illustrated in FIG. 12.

The steps of operation of the dishwashing machine are similar to the steps of operation of a typical dishwashing machine, apart from the sequencing of valves and the re-use of the machine wash water as shown in FIGS. 2-6. The steps of operation of the sink include initially filling the sink manually with a faucet. The sink is preferably filled up to a mark on the side of the sink. A button is pushed on the detergent dispenser to dispense the predetermined amount of detergent, rinse aid, or sanitizer into the appropriate sink. This is shown in FIG. 4. Alternatively, the detergent, rinse aid, or sanitizer may be automatically dispensed simultaneously while filling the sink, using pressure switches on the sink faucets to sense the flow of water.

To fill the sink, a button is pushed to start re-circulation of the sink water. The water is continuously re-circulated until the operator pushes the stop button. This is shown in FIG. 3. Another option is to use a heater to keep the re-circulated water at the proper temperature. Whenever a dishwashing machine cycle is started, the sink re-circulation is temporarily halted until the dishwashing machine cycle is done, unless the sink has a separate, independent pump.

To drain the sink, the button is pushed to stop the sink re-circulation and a manual drain is used. The manual drain may be a hand valve on the drain pipe to drain the sink.

Figure 7:
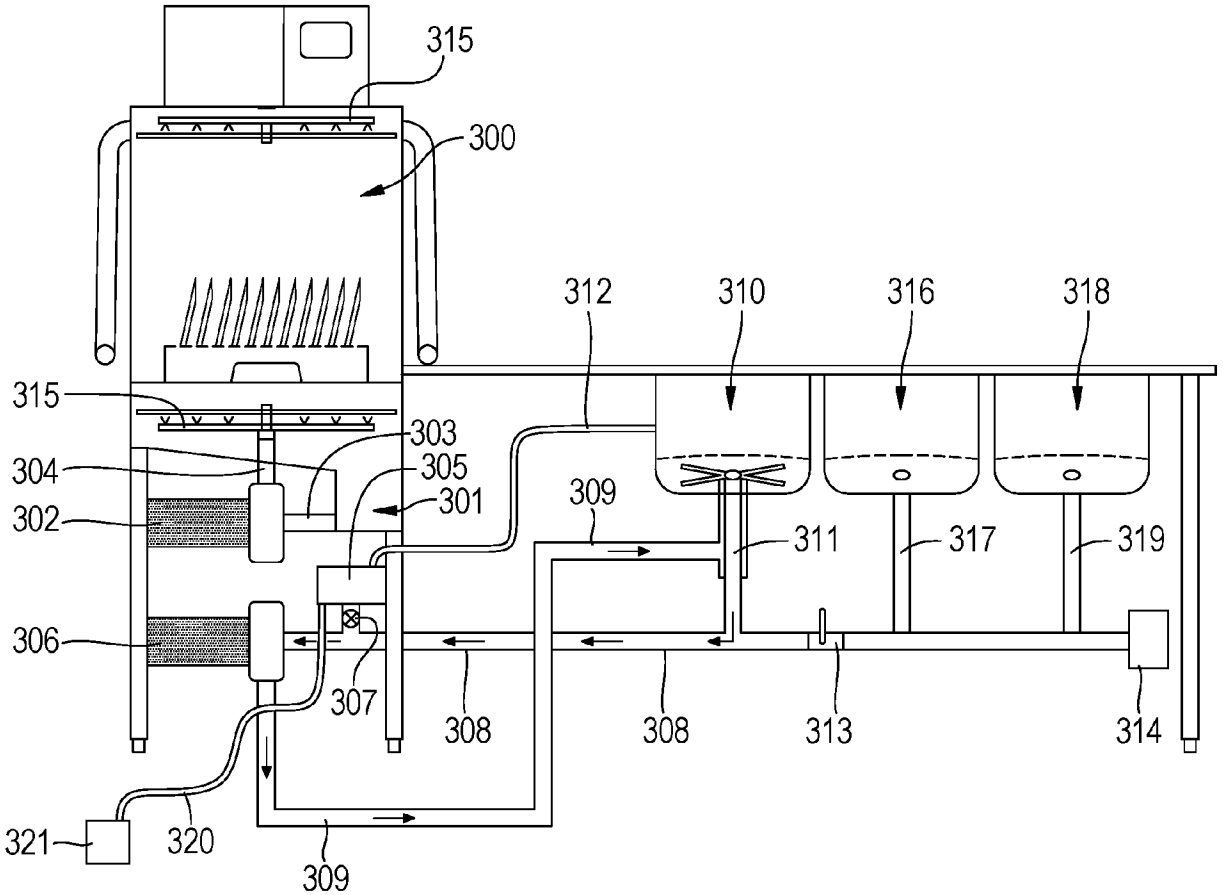
FIG. 7 is a side view of another embodiment combination dishwashing machine and sink constructed according to the principles of the present invention during operation of the dishwashing machine wash water directed to an inlet of a pump of the sink.

In another aspect of the present invention, FIG. 7, like FIGS. 2-6, shows a typical "dump and fill" type dishwashing machine 300 operatively connected to a sink 310. Because the dishwashing machine 300 is similar to the above-described dishwashing machine 200, which has been described in detail, the common components and operation of the dishwashing machine 300 will be described in less detail.

The dishwashing machine 300 includes a sump 301, and a pump 302 for the dishwashing machine 300 is in fluid communication with the sump 301. A fluid passageway 303 interconnects the sump 301 and the pump 302, and a fluid passageway 304 interconnects the pump 302 and the wash arms 315. A drain pan 305 is in fluid communication with the sump 301, and the wash water contained in the sump 301 is directed into the drain pan 305 after use in the dishwashing machine 300. The drain pan 305 is located below the sump 301 with an air gap between them. A pump 306 for the sink 310 is in fluid communication with the drain pan 305. A check valve 307 ensures that the wash water directed out of the drain pan 305 does not reenter the drain pan 305.

The sink 310 includes a drain 311. An inlet fluid passageway 308 interconnects the drain 311 of the sink 310 to the inlet of the pump 306. An outlet fluid passageway 309 interconnects the drain 311 of the sink 310 to the outlet of the pump 306. The sink 310 also includes an optional overflow 312 interconnecting and in fluid communication with the sink 310 and the drain pan 305. The overflow 312 is positioned at a desired height for the wash water level within the sink 310. As the sink 310 is filled with wash water, any wash water above the bottom of the opening of the overflow 312 flows through the overflow 312, into the drain pan 305, and then through a passageway 320 into a drain 321 thereby keeping the wash water at the desired height within the sink 310. When the sink 310 is drained, the drain pan 305 is also drained by opening the valve 313 to the drain 314.

In a three sink system, the inlet fluid passageway 308 is in fluid communication with the drains of each of the sinks and the common drain 314 into which the drains of each of the sinks empties. The drain 311 of the wash sink 310, the drain 317 of the rinse sink 316, and the drain 319 of the sanitize sink 318 drain into the inlet fluid passageway 308. A valve 313 is positioned within the inlet fluid passageway 308 between the drain 311 of the wash sink 310 and the drain 314, more preferably, between the drain 311 of the wash sink 310 and the drain 317 of the rinse sink 316. The valve 313 is in a closed position to prevent the wash water from going down the drain 314. When it is desired to drain the sink 310, the valve 313 is placed in an open position. The sink 310 is drained manually.

In operation, after the wash cycle of the dishwashing machine 300, the wash water is emptied from the sump 301 into the drain pan 305 via a stopper (not shown). The wash water is then emptied from the drain pan 305 into the inlet fluid passageway 308 and then pumped through the inlet of the pump 306, through the pump 306, through the outlet of the pump 306, through the outlet fluid passageway 309, into the drain 311, and into the sink 310. Any excess wash water above the opening in the overflow 312 is directed into the drain pan 305. When the valve 313 is opened, the wash water is drained from the sink 310 and the drain pan 305 into the inlet fluid passageway 308 and into the drain 314.

Figure 8:
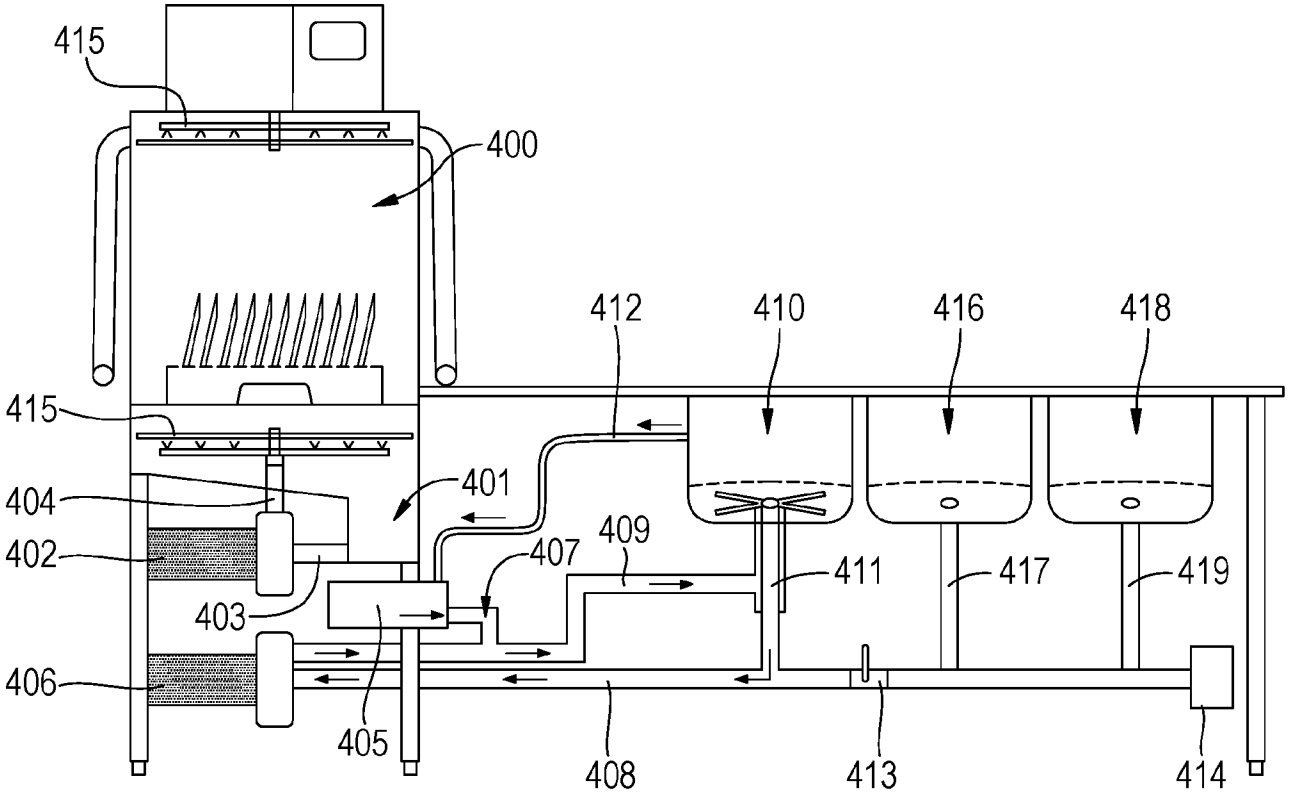
FIG. 8 is a side view of another embodiment combination dishwashing machine and sink constructed according to the principles of the present invention during operation of the dishwashing machine wash water directed to an outlet of a pump of the sink.
Figure 9:
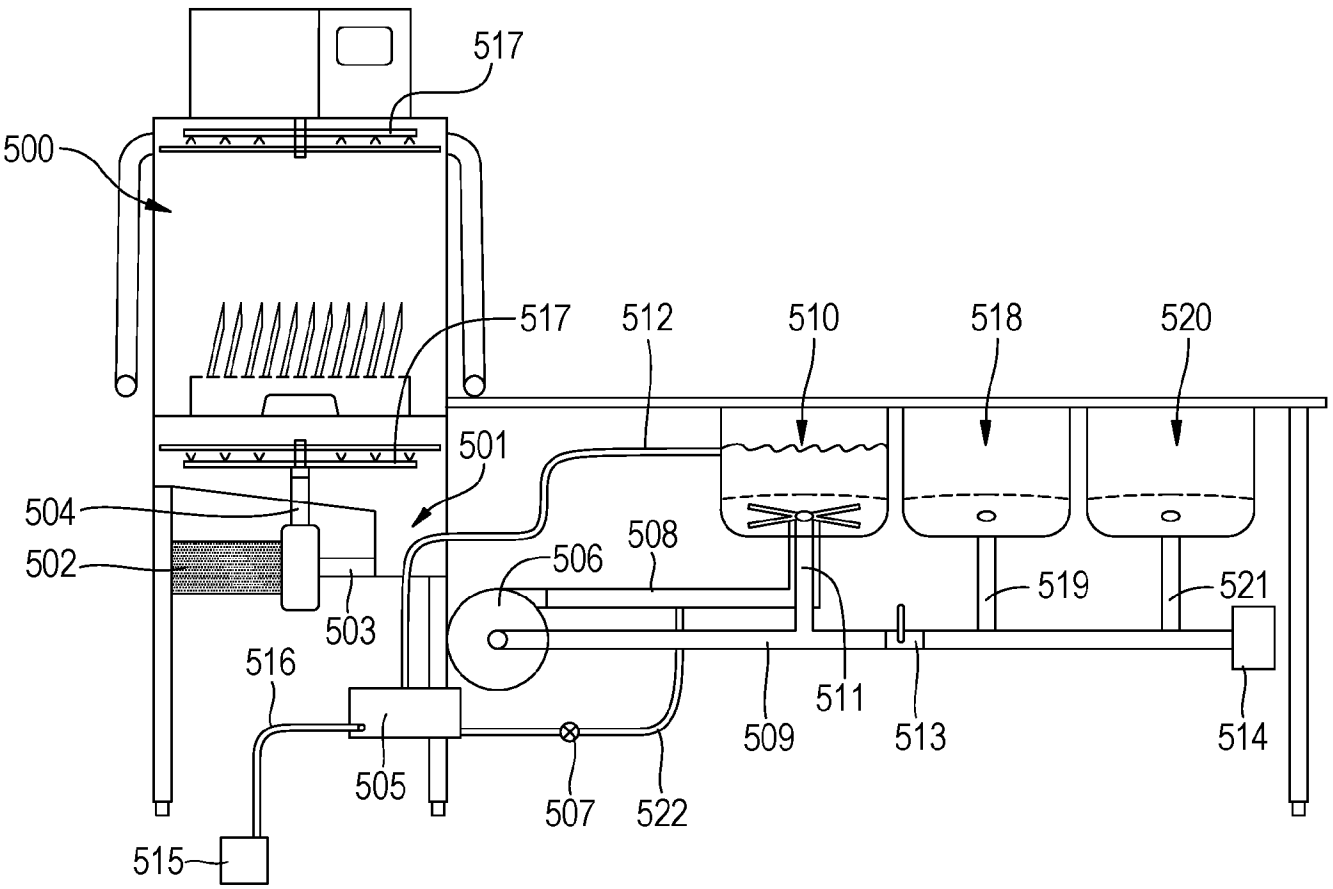
FIG. 9 is a side view of another embodiment combination dishwashing machine and sink constructed according to the principles of the present invention during operation of the dishwashing machine wash water directed to an outlet of a pump of the sink.

FIGS. 7-9 illustrate ways in which two pumps may be used without the use of valves. One pump is used to re-circulate wash water in the dishwashing machine and the second pump is used to agitate wash water in the sink. The second pump may be less expensive to implement compared to using a single pump and diverting the wash water via valves to the sink and/or the dishwashing machine. Only a check valve is used to ensure that the sink does not drain when not being agitated. Also, an overflow may be used to direct wash water back to the drain pan of the dishwashing machine. The overflow acts as a simple level control system. Oils and other floating matter upon the surface of the sink wash water will be directed to the drain pan and flushed to the drain. In FIGS. 8 and 9, air can be advantageously allowed to enter the flow stream of wash water going to the sink. The air bubbles will provide better agitation than the wash water flow alone. The air will be introduced automatically whenever the drain pan is emptied. The drain pan will empty periodically by pumping the wash water into the sink or by draining into the waste drain. The drain pan fills when the dishwashing machine dumps the wash water, but is gradually emptied as the sink pulls wash water from the drain pan and some of the wash water is allowed to go down the drain.

In another aspect of the present invention, FIG. 8 shows a typical "dump and fill" type dishwashing machine 400 operatively connected to a sink 410. Because the dishwashing machine 400 is similar to the above-described dishwashing machine 200, which has been described in detail, the common components and operation of the dishwashing machine 400 will be described in less detail.

The dishwashing machine 400 includes a sump 401, and a pump 402 for the dishwashing machine 400 is in fluid communication with the sump 401. A fluid passageway 403 interconnects the sump 401 and the pump 402, and a fluid passageway 404 interconnects the pump 402 and the wash arms 415. A drain pan 405 is in fluid communication with the sump 401, and the wash water contained in the sump 401 is directed into the drain pan 405 after use in the dishwashing machine 400. The drain pan 405 is located below the sump 401 with an air gap between them. A pump 406 for the sink 410 is in fluid communication with the drain pan 405. A check valve 407 ensures that the wash water directed out of the drain pan 405 does not reenter the drain pan 405.

The sink 410 includes a drain 411. An inlet fluid passageway 408 interconnects the drain 411 of the sink 410 to the outlet of the pump 406. An outlet fluid passageway 409 interconnects the drain 411 of the sink 410 to the inlet of the pump 406. The sink 410 also includes an optional overflow 412 interconnecting and in fluid communication with the sink 410 and the drain pan 405. The overflow 412 is positioned at a desired height for the wash water level within the sink 410. As the sink 410 is filled with wash water, any wash water above the bottom of the opening of the overflow 412 flows through the overflow 412, into the drain pan 405, and then into a drain (not shown) thereby keeping the wash water at the desired height within the sink 410.

In a three sink system, the inlet fluid passageway 408 is in fluid communication with the drains of each of the sinks and the common drain 414 into which the drains of each of the sinks empties. The drain 411 of the wash sink 410, the drain 417 of the rinse sink 416, and the drain 419 of the sanitize sink 418 drain into the inlet fluid passageway 408. A valve 413 is positioned within the inlet fluid passageway 408 between the drain 411 of the wash sink 410 and the drain 414, more preferably, between the drain 411 of the wash sink 410 and the drain 417 of the rinse sink 416. The valve 413 is in a closed position to prevent the wash water from going down the drain 414. When it is desired to drain the sink 410, the valve 413 is placed in an open position. The sink 410 is drained manually.

In operation, after the wash cycle of the dishwashing machine 400, the wash water is emptied from the sump 401 into the drain pan 405 via a stopper (not shown). The wash water is then emptied from the drain pan 405 into the outlet fluid passageway 409 and then pumped into the drain 411 and into the sink 410. The wash water is aspirated into the outlet of pump 406, and it is not a problem if the pump 406 stays on because air in the line provides better agitation and cleaning in the sink 410. Any excess wash water above the opening in the overflow 412 is directed into the drain pan 405. When the valve 413 is opened, the wash water is drained from the sink 410 into the inlet fluid passageway 408 and into the drain 414.

In another aspect of the present invention, FIG. 9 shows a typical "dump and fill" type dishwashing machine 500 operatively connected to a sink 510. Because the dishwashing machine 500 is similar to the above-described dishwashing machine 200, which has been described in detail, the common components and operation of the dishwashing machine 500 will be described in less detail.

The dishwashing machine 500 includes a sump 501, and a pump 502 for the dishwashing machine 500 is in fluid communication with the sump 501. A fluid passageway 503 interconnects the sump 501 and the pump 502, and a fluid passageway 504 interconnects the pump 502 and the wash arms 517. A drain pan 505 is in fluid communication with the sump 501, and the wash water contained in the sump 501 is directed into the drain pan 505 after use in the dishwashing machine 500. A pump 506 for the sink 510 is in fluid communication with the drain pan 505. A check valve 507 ensures that the wash water directed out of the drain pan 505 does not reenter the drain pan 505. The check valve 507 may also be a solenoid valve, a peristaltic pump, or any other suitable device known in the art.

The sink 510 includes a drain 511. An inlet fluid passageway 508 interconnects the drain 511 of the sink 510 to the outlet of the pump 506. An outlet fluid passageway 509 interconnects the drain 511 of the sink 510 to the inlet of the pump 506. The sink 510 also includes an optional overflow 512 interconnecting and in fluid communication with the sink 510 and the drain pan 505. The overflow 512 is positioned at a desired height for the wash water level within the sink 510. As the sink 510 is filled with wash water, any wash water above the bottom of the opening of the overflow 512 flows through the overflow 512, into the drain pan 505, through a waste passageway 516, and then into the drain 515 thereby keeping the wash water at the desired height within the sink 510. A standpipe (not shown) opens to allow the wash water in the drain pan 505 to drain by gravity.

In a three sink system, the inlet fluid passageway 508 is in fluid communication with the drains of each of the sinks and the common drain 514 into which the drains of each of the sinks empties. The drain 511 of the wash sink 510, the drain 519 of the rinse sink 518, and the drain 521 of the sanitize sink 520 drain into the outlet fluid passageway 509. A valve 513 is positioned within the outlet fluid passageway 509 between the drain 511 of the wash sink 510 and the drain 514, more preferably, between the drain 511 of the wash sink 510 and the drain 519 of the rinse sink 518. The valve 513 is in a closed position to prevent the wash water from going down the drain 514. When it is desired to drain the sink 510, the valve 513 is placed in an open position. The sink 510 is drained manually.

In operation, after the wash cycle of the dishwashing machine 500, the wash water is emptied from the sump 501 into the drain pan 505 via a stopper (not shown). The wash water is then emptied from the drain pan 505 into the inlet fluid passageway 508 via the passageway 522. Then, the wash water is pumped into the drain 511 and into the sink 510. The wash water is aspirated through the outlet of pump 506, and it is not a problem if the pump 506 stays on because air in the line provides better agitation and cleaning in the sink 510. Any excess wash water above the opening in the overflow 512 is directed into the drain pan 505. The wash water is drained from the drain pan 505 by opening the standpipe (not shown), and the wash water flows through the waste passageway 516 into the waste drain 515. When the valve 513 is opened, the wash water is drained from the sink 510 into the inlet fluid passageway 508 and into the drain 514.

Figure 10:
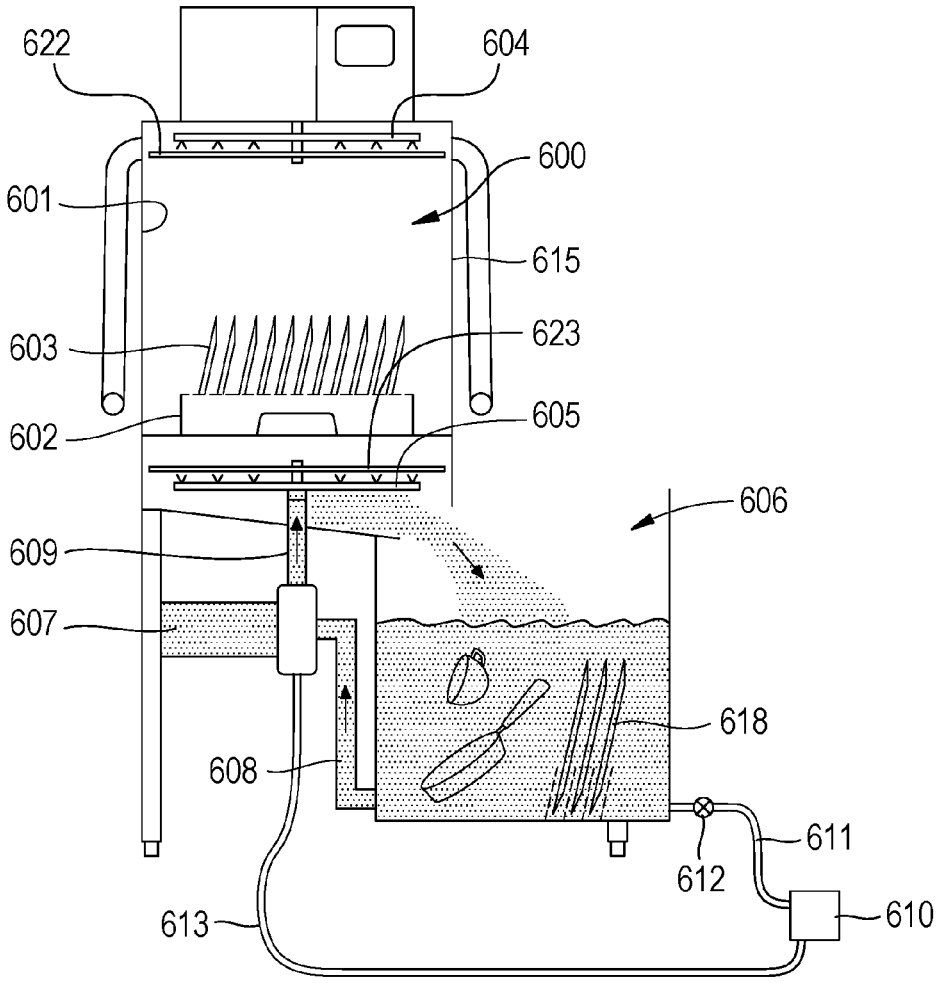
FIG. 10 is a side view of another embodiment combination dishwashing machine and sink constructed according to the principles of the present invention where the dishwashing machine and the sink share a common sump.

The present invention may also be used with a single sink option. FIG. 10 shows a "re-circulating" type dishwashing machine 600 in which the wash water is re-used until it is drained and replenished. The wash water includes the water used during each cycle of the dishwashing machine 600, including the wash water and the rinse water, including any rinse aids and sanitizers. Typically, the operator determines when the wash water has become too soiled and should be discarded and replenished. The sink 606 is both the sump for the dishwashing machine 600 and the wash sink.

The dishwashing machine 600 includes a cavity 601 of a housing 615 in which a rack 602 is positioned for holding dishes 603 within the cavity 601. Upper rinse arms 622 supply rinse water within the cavity 601 proximate the top of the housing 615 and lower rinse arms 623 supply rinse water within the cavity 601 proximate the bottom 616 of the housing 615 as is well known in the art. Similarly, upper wash arms 604 supply wash water within the cavity 601 proximate the top of the housing 615 and lower wash arms 605 supply wash water within the cavity 601 proximate the bottom 616 of the housing 615 as is also well known in the art. The bottom 616 of the housing 615 slants downward into the sink 606 so that the water used during operation of the dishwashing machine 600 drains by gravity from the bottom 616 of the housing 615 into the sink 606 containing dishes 618. A fluid passageway 608 interconnects the sink 606 and a pump 607, and a fluid passageway 609 interconnects the pump 607 and the wash arms 604 and 605. When it is desired to empty the sink 606, the wash water contained in the sink 606 flows through a drain passageway 611 into a drain 610. A valve 612 is in a closed position during the cycles of the dishwashing machine 600 and is in an open position to allow the water to be emptied from the sink 606 at the end of each cycle.

The sink 606 is automatically filled, dosed with product if appropriate, agitated, drained, and refilled for each of the wash, rinse, and sanitize cycles of the dishwashing machine 600. One sink 606 is used to wash, rinse, and sanitize the dishes 618 in the sink 606 automatically. The electronic controller of the dishwashing machine 600 controls the sink filling, the product dispensing, the water circulation (agitation), and the draining.

In operation, an operator places dirty dishes 618 into the sink 606 and presses a start button on the dishwashing machine 600 to begin the wash cycle of the dishwashing machine 600. The sink 606 may be used for dishes that will not fit within the cavity 601 of the dishwashing machine 600. During the wash cycle of the dishwashing machine 600, the sink 606 automatically fills with relatively clean, hot water and detergent from the dishwashing machine 600. The sink 606 is then circulated (agitated) via the pump 607 of the dishwashing machine 600. After a pre-set period of time (preferably approximately 30 minutes to 1 hour), the wash water is drained from the sink 606. The draining of the wash water in the sink 606 can be accomplished either by opening the valve 612 and draining by gravity or by pumping the wash water through a passageway 613 into the drain 610 using the dishwashing machine pump 607.

During the rinse step, after the wash water has been drained, the sink 606 is automatically filled with fresh, clean, hot water during the rinse cycle of the dishwashing machine 600. The sink 606 is then circulated (agitated) to rinse the dishes 618. After a pre-set period of time (preferably approximately 5 to 10 minutes), the rinse water is drained similarly to the draining step of the wash water.

During the sanitize step, after the rinse water has been drained, the sink 606 is automatically filled with fresh, clean, hot water during the sanitize cycle of the dishwashing machine 600. The sink 606 is then circulated to sanitize the dishes 618. After a pre-set period of time (preferably approximately 2 to 5 minutes), the dishwashing machine 600 signals to the operator that the complete dishwashing machine cycle is done and that the dishes 603 and 618 have been sanitized. The operator can then take the dishes 603 and 618 out of the cavity 601 and the sink 606 at his/her convenience.

At the end of the sanitize step, the operator has the option to wash another load of dishes in the sink 606 using the sanitize water as the wash water or to drain the sanitize water from the sink 606. By keeping the sanitize water in the sink 606, the sanitize water can be re-used for the next wash step, if desired. Detergent is simply added to the sanitize water and used during the next wash cycle. When the operator loads the sink 606 with new, dirty dishes and pushes the start button, the dishwashing machine 600 will automatically detect that the sink 606 is already full of sanitize water and will dispense the appropriate amount of detergent to the sanitize water and start the new wash cycle. An advantage is that the water used during each of the three cycles is at the proper temperature and the product is dosed at the proper amount.

A "cascade" method of agitating the water in the sink 606 is shown in FIG. 10. Wash water from the dishwashing machine 600 falls by gravity into the sink 606, causing a water fall or a cascade effect as it falls into the sink 606. An added benefit of this cascading water system is that dishes 603 can be easily flushed with the cascading water before being placed into the dishwashing machine 600 as a pre-rinse. Thus, bulk food soils can be washed off of the dishes 603 before the dishes 603 are placed into the dishwashing machine 600.

Figure 11:
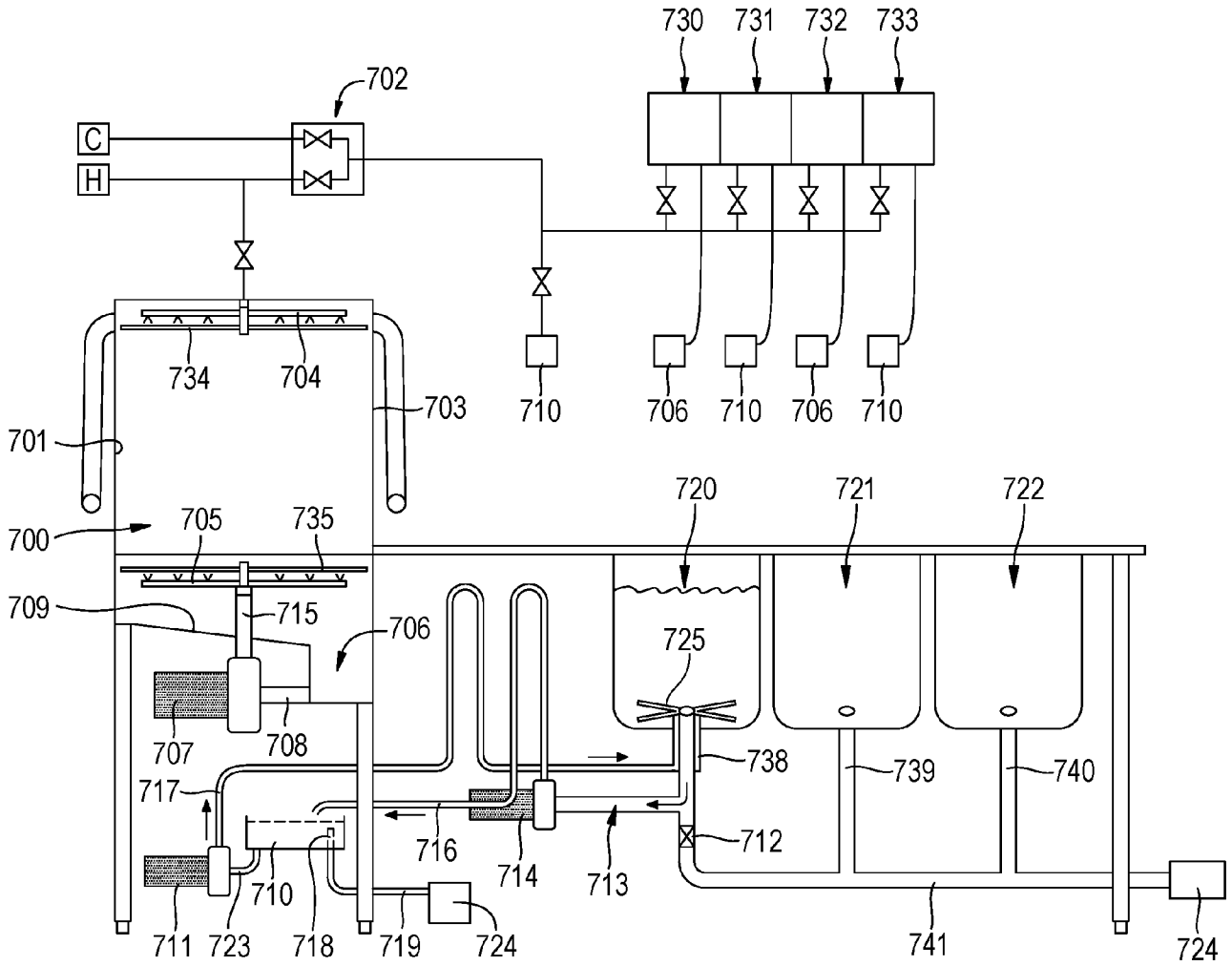
FIG. 11 is a side view of another embodiment combination dishwashing machine and sink constructed according to the principles of the present invention.

In another aspect of the present invention, FIG. 11 shows a typical "dump and fill" type dishwashing machine 700 operatively connected to a sink 720. Because the dishwashing machine 700 is similar to the above-described dishwashing machine 200, which has been described in detail, the common components and operation of the dishwashing machine 700 will be described in less detail.

The dishwashing machine 700 includes a cavity 701 of a housing 703 configured and arranged for holding dishes. Upper rinse arms 734 supply rinse water within the cavity 701 proximate the top of the housing 703 and lower rinse arms 735 supply rinse water within the cavity 701 proximate the bottom 709 of the housing 703 as is well known in the art. A cold water source C and a hot water source H supply water to the rinse arms 734 and 735, and a temperature control 702 is used to control the temperature of the water. Similarly, upper wash arms 704 supply wash water within the cavity 701 proximate the top of the housing 703 and lower wash arms 705 supply wash water within the cavity 701 proximate the bottom 709 of the housing 703 as is also well known in the art. The bottom 709 of the housing 703 slants downward into a sump 706 so that the rinse water and the wash water used during operation of the dishwashing machine 700 drain by gravity from the bottom 709 of the housing 703 into the sump 706. A fluid passageway 708 interconnects the sump 706 and a pump 707, and a fluid passageway 715 interconnects the pump 707 and the wash arms 704 and 705.

A stopper (not shown) opens to allow the wash water to flow from the sump 706 into the drain pan 710. The drain pan 710 with a level sensor well known in the art is configured and arranged to contain water from the sump 706. A pump 711 interconnects the drain pan 710 and the drain 738 of the sink 720. More specifically, a fluid passageway 723 connects the drain pan 710 to the pump 711, and a fluid passageway 717 connects the pump 711 to the drain 738. The pump 711 pumps the water from the drain pan 710 into the drain 738 of the sink 720. The drain pan 710 also includes a drain stopper 718 that lifts up to allow substantially all of the wash water in the drain pan 710 to drain through the fluid passageway 719 to the drain 724. An electromechanical device is used to lift the drain stopper 718 at the proper time. This allows the water to drain more quickly than draining by gravity flow. The drain stopper 718 may have an opening at the top to act as an overflow so that water above the drain stopper 718 will flow into the opening of the drain stopper 718 into the fluid passageway 719 to the drain 724.

If a three sink system is used, as shown in FIG. 11, the sink 720 having a drain 738 is preferably a wash sink, the sink 721 having a drain 739 is preferably a rinse sink, and the sink 722 having a drain 740 is preferably a sanitize sink. The drains are in fluid communication with a fluid passageway 741 which empties into a common drain 724 for waste. The sink 720 may also include an agitator 725 to agitate the water contained in the sink 720.

A fluid passageway 713 including a pressure gauge interconnects the drain 738 of the sink 720 and the pump 714, and a fluid passageway 716 interconnects the pump 714 and the drain pan 710. The pump 714 pumps water from the sink 720 to the drain pan 710. A valve 712 is preferably placed within the fluid passageway 741 between the drain 738 and the drain 739, and more preferably proximate the bottom of the drain 738. The valve 712 is preferably a hand valve, and the valve 712 is in a closed position to prevent the water from draining from the sink 720. The valve 712 may be placed in an open position to assist in draining the water from the sink 720. However, it is not necessary to drain the sink 720 via the valve 712 because the sink 720 is drained automatically via the pump 714.

Chemical dispensers may also be used with the present invention to automatically dispense the desired chemical into the desired device. For example, a detergent dispenser 730 may be used for dispensing detergent into the sump 706 of the dishwashing machine 700. A detergent dispenser 731 may be used for dispensing detergent into the drain pan 710. An optional rinse aid dispenser 732 may be used for dispensing rinse aid into the sump 706. A sanitizer dispenser 733 may also be used for dispensing a sanitizer into the drain pan 710.

In operation, the dishwashing machine 700 has its own pump 707 and circulation loop, and the sink 720 has its own pumps 711 and 714 and circulation loop. The water used in the dishwashing machine 700 is emptied from the sump 706 into the drain pan 710 by opening the stopper (not shown), and the water is then directed to the sink 720 by the pump 711. The pump 711 directs the water from the drain pan 710 to the sink 720. The pump 714 directs the water from the sink 720 to the drain pan 710.

The dishwashing machine 700 and the sink 720 share water and chemicals, and are indirectly connected by the drain pan 710. The operator does not have to manually fill the sink 720, add chemicals, or drain the sink 720. The sink 720 is drained automatically by pumping the water from the sink 720 to the drain pan 710 with the pump 714. The drain pan 710 has a drain stopper 718, which includes a standpipe, that lifts up to allow substantially all of the wash water in the drain pan 710 to drain through the fluid passageway 719 to the drain 724. An electromechanical device is used to lift the drain stopper 718 at the proper time. This allows the water to drain more quickly than by lifting only the standpipe portion because the opening for the drain stopper 718 is larger than the opening for the standpipe portion. The drain stopper 718 may have an opening at the top to act as an overflow so that water above the drain stopper 718 will flow into the opening of the drain stopper 718 into the fluid passageway 719 to the drain 724.

The features of the several embodiments are not limited to the respective embodiments and may be interchangeable. As shown in FIGS. 2-6, the same pump can be used to re-circulate the water for both the dishwashing machine and the wash sink, and two-way valves are used to direct the water to and from the active device. In another aspect of the present invention, as shown in FIG. 10, the dishwashing machine and the sink share a common sump. Thus, both the dishwashing machine and the sink share the same wash water, and a similar pump and valve configuration is needed to direct the flow of wash water from the sink into the dishwashing machine. Alternatively, as shown in FIGS. 7-9, separate pumps could be used for each device. If separate pumps are used, the two-way valves could be eliminated. Further, three pumps could be used, as shown in FIG. 11. The choice of a single pump with valves or of separate pumps may depend upon the relative cost of the equipment as well as upon the logistics of sequencing the operation of each device.

In a high temperature dishwashing machine, the wash water exiting the dishwashing machine is hot and is relatively clean. Typically, the wash water is allowed to go down the drain as waste after the wash cycle in the dishwashing machine. In an aspect of the present invention, the wash water is directed to the sink where it refreshes the sink water with relatively clean water and also keeps the sink water warm. An example of this is shown in FIG. 5. In another aspect of the present invention, the dishwashing machine and sink share a common sump, and the wash water in the common sump will automatically be refreshed with warm, relatively clean water after each cycle of the dishwashing machine. An example of this is shown in FIG. 10.

The dishwashing machine is preferably supplied complete so there is no need to supply a separate dispenser or chemicals for the sink. Plumbing connections such as pipes, hoses, pumps, valves, and fitments are needed to connect the dishwashing machine to the sink. Some benefits include that the same pump and valve equipment (if used) may be utilized for both the dishwashing machine and the sink, the dispensing of chemicals and water into both the dishwashing machine and the sink is automated providing control over chemical dose and water use in the sink which is typically manual, and the amount of chemicals used is reduced. Further, the re-use of the wash water from the dishwashing machine helps to keep the sink water clean and warm thus saving water, energy, and chemicals as compared to manually refreshing the sink with hot water.

The electronic controller sequences the operation of the dishwashing machine and the sink by controlling the pump action, the chemical dosing, the sink filling, and the sink draining by the software in the electronic controller. The use of electronic controllers is well known in the art. Sensors may be included to signal the controller when to stop and start certain functions, for example, the automated filling of the sink. An operator interface with the controller may be included so that the operator can manually signal the start and the stop of certain operations.

Utilizing a single pump with a valve on the pump inlet and a valve on the pump outlet allows for the most flexibility for the system. The two valves direct the flow of water from the pump to either the sink or the dishwashing machine. Alternatively, a pump for the dishwashing machine and a pump for the sink could be used. However, re-using the wash water from the dishwashing machine in the sink and filling of the sink automatically may be more complicated with two separate pumps rather than one pump with two valves.

The present invention is not limited to use in dishwashing applications but may also be used for other cleaning systems such as laundry machines, clean in place systems, parts washers, and car wash systems.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A combination dishwashing machine and sink that utilizes a first use solution, comprising:

a) a dishwashing machine having at least one wash arm;

b) a sump in fluid communication with the dishwashing machine and configured and arranged to contain the first use solution utilized in the dishwashing machine;

c) a pump in fluid communication with the sump, the pump operatively connected to a two-way valve;

d) a sink with a drain;

e) a first fluid passageway interconnecting the pump and the at least one wash arm;

f) a second fluid passageway interconnecting the pump and the sink;

g) a third fluid passageway interconnecting the drain and the pump; and h) a controller operatively connected to the pump and being programmed to signal the pump to direct the first use solution from the sump, through the first fluid passageway, and into the at least one wash arm, the controller being programmed to signal the pump to direct the first use solution from the sump, through the second fluid passageway, and into the sink, the controller automating the filling of the sink with the first use solution from the sump, the controller being programmed to signal the pump to direct the first use solution from the sink, through the drain, through the third fluid passageway, through the second fluid passageway, and into the sink.

2. The combination dishwashing machine and sink of claim 1, further comprising a second use solution contained in the sink prior to directing the first use solution into the sink, the first use solution from the sump refreshing the second use solution with each cycle of the dishwashing machine.

3. The combination dishwashing machine and sink of claim 2, wherein the addition of the first use solution to the second use solution agitates the first use solution and the second use solution in the sink.

4. The combination dishwashing machine and sink of claim 2, further comprising:

an inlet valve and an outlet valve of the pump, wherein the inlet valve and the outlet valve are open toward the dishwashing machine during use of the first use solution in the dishwashing machine, the first use solution being directed from the sump into the dishwashing machine via the first fluid passageway, and wherein the inlet valve and the outlet valve are open toward the sink during refreshing of the second use solution with the first use solution in the sink, the first use solution being directed from the sump into the sink via the second fluid passageway, the controller being programmed to open the inlet valve and the outlet valve toward the dishwashing machine and toward the sink.

5. The combination dishwashing machine and sink of claim 2, further comprising an agitator in the sink, the agitator agitating the first use solution and the second use solution in the sink.

6. The combination dishwashing machine and sink of claim 2, further comprising an overflow drain in the sink, the overflow drain being positioned at a desired level in the sink and acting as a level control in the sink, wherein as the first use solution is added to the sink to refresh the second use solution, the sink contains excess use solution and the excess use solution is directed out of the sink through the overflow drain.

7. The combination dishwashing machine and sink of claim 2, further comprising a manual valve for draining the first use solution and the second use solution from the sink.

8. The combination dishwashing machine and sink of claim 1, further comprising:

a second pump directing the first use solution from the sump into the at least one wash arm via the first fluid passageway for use in the dishwashing machine, the controller being programmed to signal the second pump to direct the first use solution from the sump, through the first fluid passageway, and into the wash arm.

9. The combination dishwashing machine and sink of claim 1, further comprising a first dispenser dispensing a chemical diluted with water into the dishwashing machine to create the first use solution, the controller being programmed to automate the dose of the chemical dispensed with water to create the first use solution.

10. The combination dishwashing machine and sink of claim 9, further comprising:

a) a second sink containing a third use solution; and b) a second dispenser dispensing a second chemical diluted with water into the dishwashing machine to create a fourth use solution, wherein the fourth use solution is directed into the second sink after use in the dishwashing machine to refresh the third use solution in the second sink, the controller being programmed to automate the dose of the second chemical with water to create the fourth use solution.

11. The combination dishwashing machine and sink of claim 10, wherein the first use solution includes a detergent and the fourth use solution includes a sanitizer.

12. The combination dishwashing machine and sink of claim 1, further comprising air directed into the sink to increase agitation within the sink.

13. A combination dishwashing machine and sink for use with a dispenser for dispensing a use solution, comprising:

a) a dishwashing machine having a nozzle within a cavity;

b) a sink;

c) a sump in fluid communication with the cavity of the dishwashing machine, the use solution draining from the cavity into the sump, the sump configured and arranged to contain the use solution utilized in the dishwashing machine;

d) a first fluid passageway interconnecting the nozzle of the dishwashing machine and the sump;

e) a first pump in fluid communication with the sump and the nozzle;

f) a second fluid passageway interconnecting the sink and the sump;

g) a second pump in fluid communication with the sump and the sink; and h) a controller operatively connected to the first pump and to the second pump, the controller being programmed to signal the first pump to direct the use solution from the sump into the nozzle via the first fluid passageway, and the controller being programmed to signal the second pump to direct the use solution from the sump into the sink via the second fluid passageway, and the controller being programmed to signal the second pump to direct the use solution from the sink through a drain in the sink and back into the sink.

14. The combination dishwashing machine and sink of claim 13, further comprising a dispenser dispensing a chemical diluted with water into the dishwashing machine to create the use solution, the controller being programmed to automate the dose of the chemical dispensed with water to create the use solution.

15. The combination dishwashing machine and sink of claim 13, further comprising a second use solution contained in the sink prior to directing the use solution into the sink, the use solution from the sump refreshing the second use solution with each cycle of the dishwashing machine.

16. The combination dishwashing machine and sink of claim 15, wherein the addition of the use solution to the second use solution agitates the use solution and the second use solution in the sink.

17. The combination dishwashing machine and sink of claim 15, further comprising an agitator in the sink, the agitator agitating the use solution and the second use solution in the sink.

18. The combination dishwashing machine and sink of claim 15, further comprising an overflow drain in the sink, the overflow drain being positioned at a desired level in the sink and acting as a level control in the sink, wherein as the use solution is added to the sink to refresh the second use solution, the sink contains excess use solution and the excess use solution is directed out of the sink through the overflow drain.

19. The combination dishwashing machine and sink of claim 13, further comprising air directed into the sink to increase agitation within the sink.

20. A combination dishwashing machine and sink for use with a dispenser for dispensing a use solution, comprising:

a) a dishwashing machine having a cavity and a nozzle contained within the cavity, the cavity being configured and arranged to contain first dishes;

b) a sink in fluid communication with the cavity and configured and arranged to contain second dishes, the sink storing the use solution and soaking the second dishes with the use solution;

c) a fluid passageway interconnecting the nozzle and the sink; and d) a pump directing the use solution from the sink into the nozzle via the fluid passageway, the nozzle applying the use solution onto the first dishes in the cavity, the use solution draining into the sink after use in the cavity, the pump re-circulating the use solution from the sink into the cavity, the use solution concurrently cleaning the first dishes and soaking the second dishes, and a controller being programmed to perform said process.

21. The combination dishwashing machine and sink of claim 20, wherein the use solution cascades from the cavity over the second dishes in the sink, the cascading use solution agitating the use solution in the sink.

22. The combination dishwashing machine and sink of claim 20, further comprising air directed into the sink to increase agitation within the sink.

23. A retrofit kit for converting a sink into a combination dishwashing machine and sink, comprising:

a) a dishwashing machine having a nozzle;

b) a drain configured and arranged to be connected to the sink;

c) a controller; and d) a pump having an inlet valve and an outlet valve, the pump being in fluid communication with the dishwashing machine, the sink, and the drain, the controller being operatively connected to the inlet valve and the outlet valve, the controller being programmed to open the inlet valve and the outlet valve toward the dishwashing machine when directing a use solution to the nozzle of the dishwashing machine, and the controller being programmed to open the inlet valve and the outlet valve toward the sink when directing the use solution from the dishwashing machine to the sink, and the controller being programmed to open the inlet valve and the outlet valve when directing the use solution from the sink, through the drain, and into the sink.

24. The retrofit kit of claim 23, further comprising:

a) a sump in fluid communication with the dishwashing machine and configured and arranged to contain the use solution utilized in the dishwashing machine, the sump being in fluid communication with the pump; and b) a first fluid passageway interconnecting the sump and the sink, the inlet valve and the outlet valve being open toward the sink when directing the use solution from the sump into the sink via the first fluid passageway.

25. The retrofit kit of claim 24, further comprising a second fluid passageway interconnecting the sump and the nozzle, the inlet valve and the outlet valve being open toward the dishwashing machine when directing the use solution from the sump into the nozzle via the second fluid passageway.

26. A method of automatically filling a sink with a use solution utilized in a dishwashing machine, the use solution including a detergent, comprising:

a) collecting the use solution utilized in the dishwashing machine;

b) directing the use solution collected from the dishwashing machine into the sink;

c) filling the sink with the use solution collected from the dishwashing machine;

d) and a controller being programmed to perform said process, wherein the controller signals a pump to direct the use solution from the sink through a drain in the sink and back into the sink.

27. The method of claim 26, further comprising soaking dishes in the sink filled with the use solution collected from the dishwashing machine.

28. The method of claim 27, further comprising agitating the use solution in the sink.

29. The method of claim 26, further comprising refreshing the use solution in the sink with additional use solution from subsequent cycles of the dishwashing machine.

30. The method of claim 29, further comprising directing excess use solution out of the sink via an overflow drain.

31. The method of claim 26, further comprising directing air into the sink to increase agitation within the sink.

* * * * *